US006094006A

United States Patent [19]

Park

[11] Patent Number: 6,094,006

[45] Date of Patent: Jul. 25, 2000

[54] CATHODE-RAY TUBE

[75] Inventor: Sang-Yoon Park, Seoul, Rep. of Korea

[73] Assignee: LG Electronics Inc., Seoul, Rep. of Korea

[21] Appl. No.: 08/978,819

[22] Filed: Nov. 26, 1997

[30] Foreign Application Priority Data

Nov. 30, 1996 [KR] Rep. of Korea ..... 96/60303
Nov. 30, 1996 [KR] Rep. of Korea ..... 96/60304

[51] Int. Cl.[7] ..... H01J 31/00; H01J 29/80; H01J 29/10

[52] U.S. Cl. ..... 313/477 R; 313/402; 313/404; 313/407; 313/408; 313/461; 313/479

[58] Field of Search ..... 174/75, 35 MS; 313/402, 461, 477 R–479, 404, 407, 408; 315/89

[56] References Cited

U.S. PATENT DOCUMENTS 4,710,670 12/1987 Dougherty et al. ..... 313/407
4,779,023 10/1988 Strauss ..... 313/402
4,849,671 7/1989 Fendley ..... 313/407
4,857,795 8/1989 Wakita et al. ..... 313/402

*Primary Examiner*—Nimeshkumar D. Patel
*Assistant Examiner*—Mack Haynes
*Attorney, Agent, or Firm*—Finnegan, Henderson, Farabow, Garrett & Dunner, L.L.P.

[57] ABSTRACT

A cathode-ray tube including: a flat panel with an inside to which fluorescent material of Red, Green and Blue is applied; a funnel combined to a rear end of the flat panel; an electron gun provided in a neck part of the funnel and radiating electron beam; a flat tension shadow mask installed to the inside of the flat panel at regular intervals and having a plurality of passing holes formed for the passage of electron beams; a rail supporting the flat tension shadow mask for regularly maintaining interval of the tension shadow mask and a surface of the panel; and a magnetic shield shielding an external magnetic field, where the rail has a magnetic shield connecting part for installing the magnetic shield within the cathode-ray tube.

25 Claims, 4 Drawing Sheets

( a )

( b )

( c )

CATHODE-RAY TUBE

BACKGROUND OF THE INVENTION

1. Field of the Invention

The present invention relates to a shield fixing device for a cathode-ray tube, and more particularly to a rail for a flat cathode-ray tube supporting a shadow mask to regularly maintain an interval between the shadow mask and a panel.

2. Discussion of Related Art

Generally, as shown in FIG. 1, a flat cathode-ray tube comprises: a panel 3 with an inside surface to which fluorescent film 1 of Red, Green and Blue is applied and with a front surface to which a safety glass 2 is fixed; a funnel 4 welded to a rear part of the panel 3 to keep an inside of the flat cathode-ray tube in a vacuous state; an electron gun 7 provided in a neck part 5 of the funnel 4 to radiate electron beam 6; a shadow mask 8 installed to the inside of the panel 3, having a function of sorting the electron beam 6 into the colors; four divided rails 9 supporting the shadow mask at regular intervals along the panel 3; a magnetic shield 10 installed to an outside of the funnel 4 to shield an external magnetic field; and a reinforcement band 11 installed to the rim of the side of the panel 3 to prevent a firecracking phenomenon of the flat cathode-ray tube. And, a shadow mask supporting part 9*a* is formed on the rail 9.

In the conventional flat cathode-ray tube structured as mentioned above, since the rail 9 had the shadow mask supporting part 9*a* capable of fixing only the shadow mask 8 as shown in FIG. 2, there was no space for installing the magnetic shield 10 and therefore, the magnetic shield 10 had to be installed to the outside of the cathode-ray tube.

Accordingly, the magnetic shield 10 was easily destroyed, thereby causing the bad appearance of the product, and there was a danger of accident due to the leakage of high voltage current.

Furthermore, the reinforcement band 11 is fixed to the surface of the panel 3 under the tension so that panel 3, lug and magnetic shield 10 may be unified. Since the panel 3 used in the flat cathode-ray tube uses the cut flat glass, the size of the flat glasses is not uniform. Therefore, folds may be generated when the magnetic shield 10 is tightened by the reinforcement band 11, and also the position of the lug may be changed. Accordingly, another problem was that the manufacturing process and reliability deteriorated.

SUMMARY OF THE INVENTION

The present invention is directed to a rail structure of a flat cathode-ray tube that substantially obviates one or more of the problems caused by limitations and disadvantages of the related art.

An object of the present invention is to provide a cathode-ray tube, capable of preventing bad appearance of the product and the destruction of the magnetic shield, and having a simplified connecting process of the reinforcement band by installing a magnetic shield within a cathode-ray tube.

Additional features and advantages of the invention will be set forth in the description which follows, and in part will be apparent from the description, or may be learned by practice the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a cathode-ray tube comprises a flat panel having an inside, a funnel connected to the inside of the flat panel, and a magnetic shield within said funnel.

According to another aspect, the cathode-ray tube further includes a tension shadow mask and one or more rails connected to the inside of the flat panel. Each rail has a part connecting the magnetic shield and another part connecting the tension shadow mask.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

Figure 5:
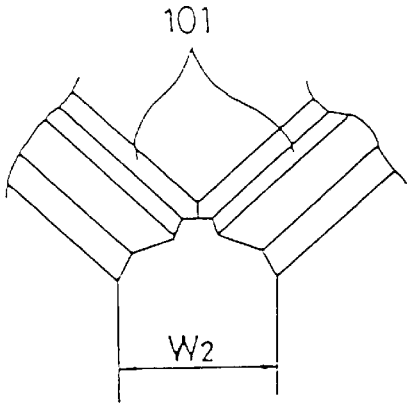
Figure 5:
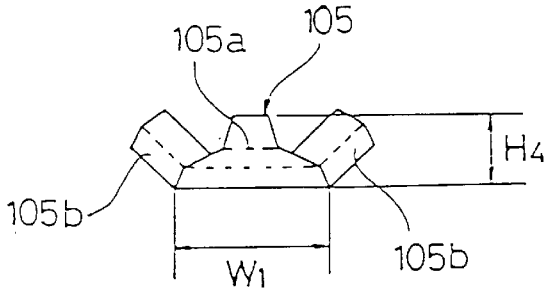
Figure 5:
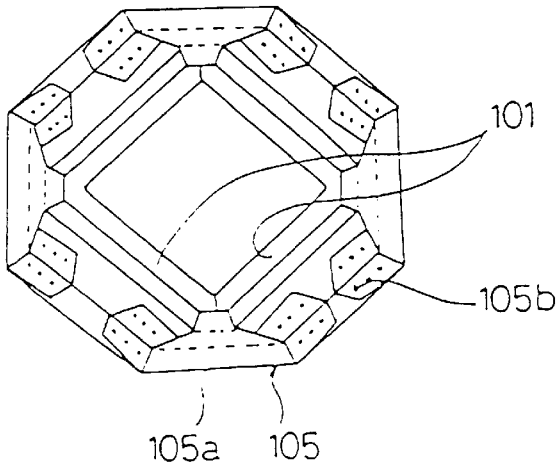
Figure 6:
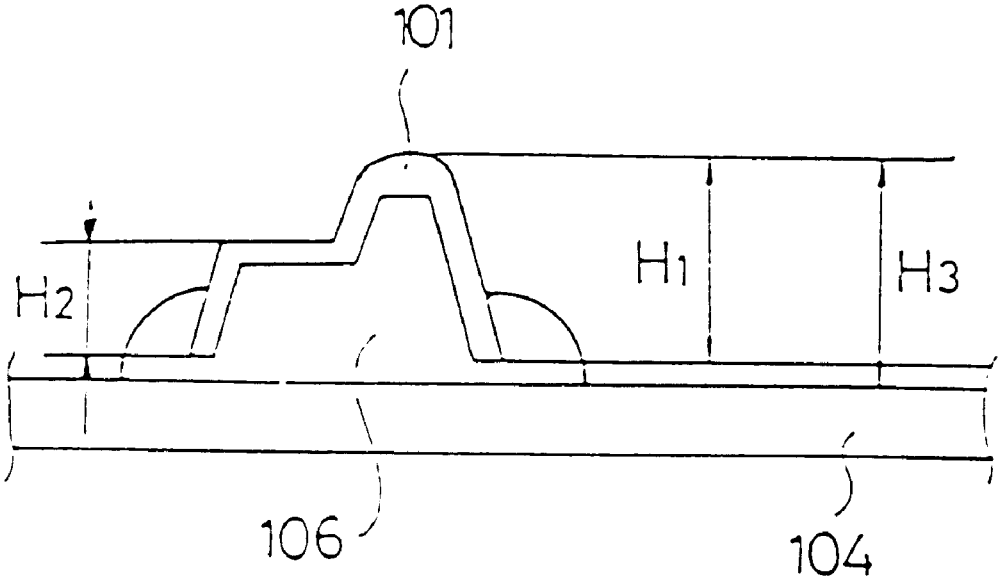

FIG. 5*a* is a view showing rails that are facing;

FIG. 5*b* is a view showing a structure of a connecting instrument;

FIG. 5*c* is a view showing a combination of the rail and the connecting instrument; and FIG. 6 is a view showing that the rail is welded to a surface of a panel according to the present invention.

DETAILED DESCRIPTION OF PREFERRED EMBODIMENT

Reference will now be made in detail to the preferred embodiments of the present invention, examples of which are illustrated in the accompanying drawings.

Figure 1:
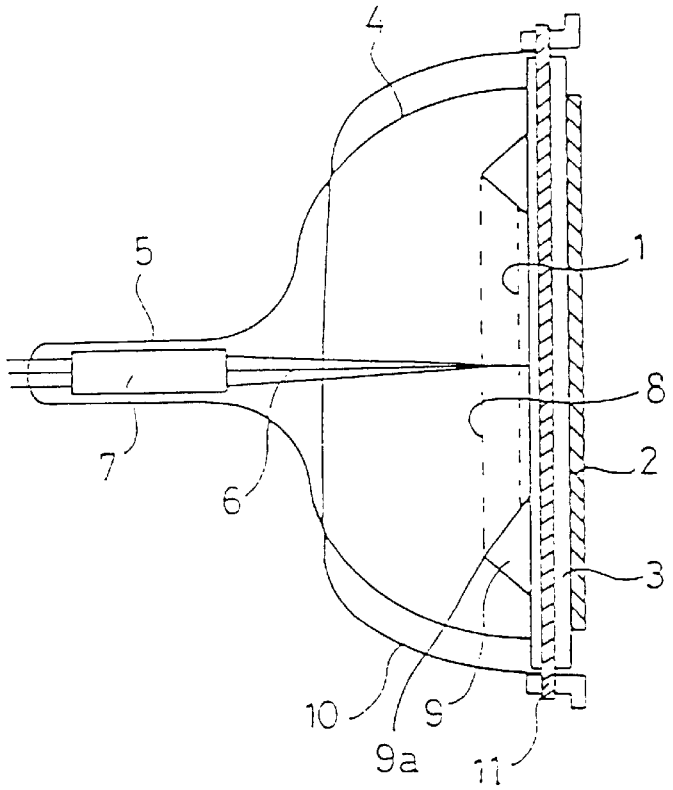
Fig 1 PRIOR ART
FIG. 1 is a view showing a structure of a conventional flat cathode-ray tube.
Figure 2:
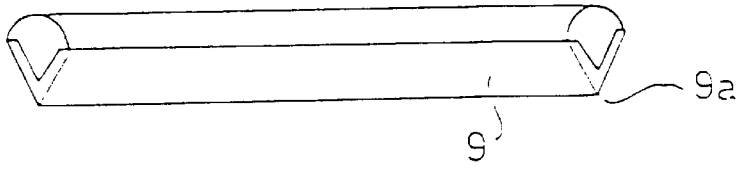
Fig 2 PRIOR ART
FIG. 2 is a detail view of a rail for a conventional flat cathode-ray tube.
Figure 3:
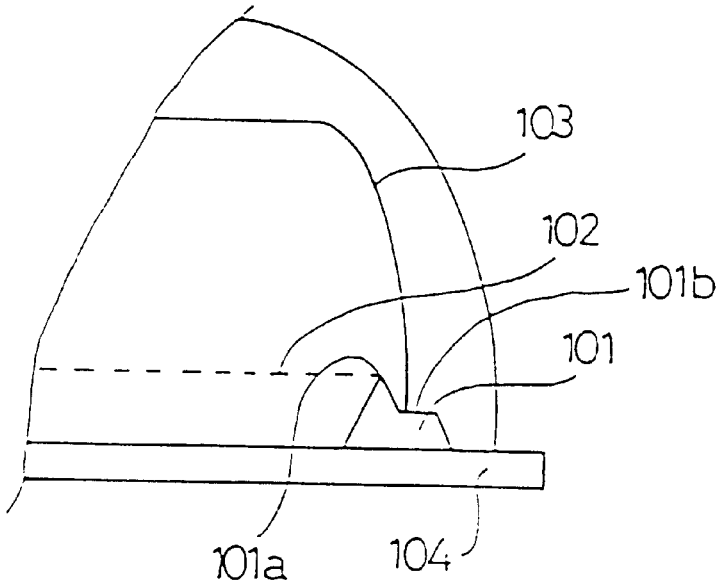
FIG. 3 is a sectional view of a cathode-ray tube in accordance with the present invention.

According to an embodiment of the present invention, a cathode-ray tube, preferably of a flat type, as shown in FIG. 3, a rail 101 supporting a shadow mask 102, which has a function of sorting an electron beam into the colors, is attached to a panel 104 with an inside surface to which fluorescent material of Red, Green and Blue is applied.

Figure 4:
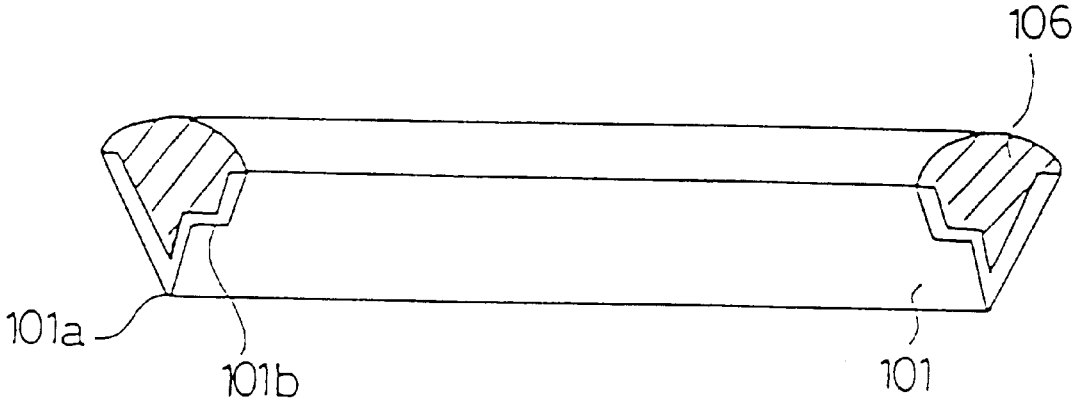
FIG. 4 is a detail view of the rail in accordance with the present invention.

As shown in FIG. 4, the rail 101 is provided with a shadow mask weld part 101*a* to which the shadow mask 102 is welded and with a magnetic shield weld part 101*b* to which a magnetic shield 103 is welded, and the magnetic shield weld part 101*b* is formed so as to be parallel with the surface of the panel 104.

At this time, for removing interference between the shadow mask 102 and the magnetic shield 103 after the shadow mask 102 is attached to the magnetic shield 103, the height of the shadow mask weld part 101*a* is formed to be higher than that of the magnetic shield weld part Further, to prevent a path of the electron beam from being cut by the magnetic shield 103, the shadow mask weld part 101*a* is positioned toward the axis direction of the flat cathode-ray tube compared with the magnetic shield weld part 101*b*.

The shadow mask weld part 101*a* provides a space such that a weld path may not escape from the rail 101 upon welding the shadow mask 102 of a thin film after the rail 101 is welded to the panel 104. The magnetic shield weld part 101*b* provides enough space to place the magnetic shield 103 on the rail for its welding.

The magnetic shield weld part 101*b* has enough height to prevent the frit glass 106 pushed by the panel 104's own weight from going up when the rail 101 is welded on the surface of the panel 104 by means of a frit glass 106.

And, there is provided a connecting instrument 105 connecting four divided rails 101 in a unified form for easily installing the magnetic shield 103 within the cathode-ray tube.

The connecting instrument 105, as shown in FIG. 5, comprises a body 105*a* preventing a leak of the frit glass filled in the rail and a combination part 105*b* which is formed unified with the body 105*a* and combined with the rail.

And, the combination part 105*b* is formed in a form of "¬" as shown in FIG. 5*b*, for maximizing area contacted by the rails 101.

In the method of connecting the rail for the flat cathode-ray tube to the panel surface, edges of the inside surface of the four divided rails, which have the shadow mask weld part 101 and the magnetic shield weld part 101*b* , are first faced with each other, and then divided rails 101 are formed in a unified form by means of connecting instrument 105 as connecting means. The frit 106 is fully filled in the rail combination 101 and 105, and then, the rail combination 101 and 105 is welded to the panel 104 under high temperature. The shadow mask 102 and the magnetic shield 103 are respectively welded to each of weld parts 101*a* and 101*b*. Thereby, the connecting process is completed.

At this moment, the combination part 105*b* of the connecting instrument 105 is installed to the outside of the magnetic shield weld part 101*b* at the inside surface thereof.

Here, as shown in FIG. 6, the magnetic shield weld part 101*b* is designed to have the height $H_2$ enough to prevent the frit glass 106 pushed by the panel 104's own weight from going up when the rail 101 is welded to the surface of the panel 104 by the frit glass 106 under the high temperature.

Further, the height $H_4$ of the connecting instrument 105 is formed to be lower than the entire height $H_1$ of the rail 101 to prevent the rail combination 101 and 105 from being inclined when the rail combination is welded to the surface of the panel 104. The amount of the pushed frit glass 106 is controlled to be minimized so that the entire height $H_3$ of the finished product may generally be leveled. This is for minimizing the difference in the evenness of the height from the inside of the panel 104 to the upper end of the rail combination 101 and 105.

And, the width $W_1$ of the body 105 of the connecting instrument 105 is narrower than the width $W_2$ when edges of the four divided rails 101 are faced in order to minimize the gap during the welding process.

As discussed previously, in the present invention, the magnetic shield is installed within the flat cathode-ray tube and therefore, there are advantages of preventing the cathode-ray tube from being easily destroyed and of promoting the reliability of the product.

It will be apparent to those skilled in the art that various modifications and variations can be made in rail structure of a flat cathode-ray tube of the present invention without departing from the spirit or scope of the invention. Thus, it is intended that the present invention cover the modifications and variations of this invention provided they come within the scope of the appended claims and their equivalents.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cathode-ray tube comprising:

a flat panel having an inside coated with a fluorescent material;

a funnel connected to the inside of said flat panel;

an electron gun in said funnel for radiating electron beams;

a flat tension shadow mask connected to the inside of said flat panel;

a magnetic shield within said funnel; and one or more rails connected to said flat panel, wherein each rail having a stair shaped end surface, a first part connecting said tension mask and a second part connecting said magnetic shield.

2. A cathode-ray tube as in claim 1, wherein said first part of each rail is further away from said panel than said second part of each rail.

3. A cathode-ray tube as in claim 1, wherein said one or more rails includes a plurality of rails connected to one another by at least one rail connecting instrument.

4. A cathode-ray tube as in claim 3, wherein said plurality of rails contain frit glass and each connecting instrument has a body which prevents leakage of the frit glass from said rails.

5. A cathode-ray tube as in claim 4, wherein each connecting instrument extends a smaller distance from the inside of said panel than each rail.

6. A cathode-ray tube as in claim 4, wherein said connecting instrument has a combination part inside each rail, but outside of said magnetic shield.

7. A cathode-ray tube as in claim 6, wherein an end surface of said combination part is roughly L-shaped to be easily contacted with each rail.

8. A cathode-ray tube comprising:

a flat panel having an inside coated with a fluorescent material;

a funnel connected to the inside of said flat panel;

an electron gun in said funnel for radiating electron beams;

a flat tension shadow mask connected to the inside of said flat panel;

a magnetic shield within said funnel; and one or more rails having stair shaped end surfaces connected to said flat panel, each rail having a first part connecting said tension shadow mask and a second part connecting said magnetic shield, wherein said second part of each rail is substantially parallel to said flat panel.

9. A cathode-ray tube comprising:

a flat panel having an inside coated with a fluorescent material;

a funnel connected to the inside of said flat panel;

an electron gun in said funnel for radiating electron beams;

a flat tension shadow mask connected to the inside of said flat panel;

a magnetic shield within said funnel; and one or more rails having stair shaped end surfaces connected to said flat panel, each rail having a first part connecting said tension shadow mask and a second part connecting said magnetic shield, wherein said first part of each rail is substantially normal to said fiat panel.

10. A cathode-ray tube comprising:

a flat panel having an inside surface;

funnel connected to the inside surface of said flat panel;

one or more rails connected to the inside of said flat panel, each having a stair-shaped end surface; an a magnetic shield within said funnel coupled to said one or more rails.

11. A cathode-ray tube as in claim 10, wherein said magnetic shield is coupled to the inside of said flat panel.

12. A cathode-ray tube as in claim 10, further comprising:

a flat tension shadow masks, wherein said one or more rails being connected to the inside of said flat panel, each having a part supporting said flat tension shadow mask and a part supporting said magnetic shield.

13. A cathode-ray tube as in claim 12, wherein said magnetic shield supporting part is substantially parallel with said flat panel.

14. A cathode-ray tube as in claim 12, wherein said tension shadow mask supporting part is substantially normal to said flat panel.

15. A cathode-ray tube as in claim 12, wherein said tension mask supporting part of each rail is further away from said panel than said magnetic shield supporting part.

16. A cathode-ray tube as in claim 12, wherein said one or more rails includes a plurality of rails connected to one another by at least one rail connecting instrument.

17. A cathode-ray tube comprising:

a flat panel having an inside;

a tension shadow mask coupled to the inside of said flat panel;

a magnetic shield coupled to the inside of said flat panel; and one or more rails connected to the inside of said panel, each rail having a first part connecting said tension shadow mask and a second part connecting said magnetic wherein an end surface of each rail is stair shaded.

18. A cathode-ray tube as in claim 17, wherein said second part of each rail is substantially parallel with said flat panel.

19. A cathode-ray tube as in claim 17, wherein said first part of each rail is substantially normal to said flat panel.

20. A cathode-ray tube as in claim 17, wherein said first part of each rail is further away from said panel than said second part of each rail.

21. A cathode-ray tube as in claim 17, wherein said one or more rails includes a plurality of rails connected to one another by at least one rail connecting instrument.

22. A cathode-ray tube as in claim 21, wherein said plurality of rails contain frit glass and each connecting instrument has a body which prevents leakage of the frit glass from said rails.

23. A cathode-ray tube as in claim 21, wherein each connecting instrument extends a smaller distance from the inside of said panel than each rail.

24. A cathode-ray tube as in claim 21, wherein said connecting instrument has a combination part inside each rail, but outside of said magnetic shield.

25. A cathode-ray tube as in claim 24, wherein an end surface of the combination part is roughly L-shaped to be easily contacted with each rail.

* * * * *

UNITED STATES PATENT AND TRADEMARK OFFICE

CERTIFICATE OF CORRECTION

PATENT NO.: 6,094,006

DATED: July 25, 2000

INVENTOR: Sang-Yoon PARK

It is certified that an error appears in the above-identified patent and that said Letters Patent is hereby corrected as shown below:

Claim 9, Column 5, line 3, "fiat" should read --flat--.

Claim 10, Column 5, line 6, before "funnel", insert --a--.

Claim 10, Column 5, line 8, "surface; an" should read --surface; and--.

Claim 12, Column 5, line 15, "masks," should read --mask,--.

Claim 17, Column 6, lines 7-8, after "magnetic", insert --shield,--.

Claim 17, Column 6, line 9, "shaded" should read --shaped--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*